US011781358B2

(12) United States Patent
Lee et al.

(10) Patent No.: US 11,781,358 B2
(45) Date of Patent: Oct. 10, 2023

(54) HINGE DEVICE HAVING TENSION MAINTAINING FUNCTION

(71) Applicant: SEGOS CO., LTD., Incheon (KR)

(72) Inventors: Doo Myun Lee, Incheon (KR); Sung Joon Kang, Incheon (KR); In Suk Ra, Bucheon-Si (KR); Jung Kyu Lim, Incheon (KR); Dong Wook Kim, Seoul (KR)

(73) Assignee: SEGOS CO., LTD., Incheon (KR)

( * ) Notice: Subject to any disclaimer, the term of this patent is extended or adjusted under 35 U.S.C. 154(b) by 0 days.

(21) Appl. No.: 17/619,876

(22) PCT Filed: Jun. 25, 2020

(86) PCT No.: PCT/KR2020/008297
§ 371 (c)(1),
(2) Date: Dec. 16, 2021

(87) PCT Pub. No.: WO2020/262993
PCT Pub. Date: Dec. 30, 2020

(65) Prior Publication Data

US 2022/0341233 A1 Oct. 27, 2022

(30) Foreign Application Priority Data

Jun. 25, 2019 (KR) ..... 10-2019-0075940

(51) Int. Cl.
*E05F 1/10* (2006.01)
*A47L 15/42* (2006.01)
*F24C 15/02* (2006.01)

(52) U.S. Cl.
CPC ..... *E05F 1/1083* (2013.01); *A47L 15/4261* (2013.01); *F24C 15/023* (2013.01);
(Continued)

(58) Field of Classification Search
CPC .. E05F 1/1083; A47L 15/4261; F24C 15/023; E05Y 2201/48; E05Y 2201/654; E05Y 2201/688; E05Y 2900/304
See application file for complete search history.

(56) References Cited

U.S. PATENT DOCUMENTS 5,386,884 A * 2/1995 Chisholm ..... F16F 1/18 49/386
5,980,006 A * 11/1999 Wilhelmstatter ..... E05F 1/10 312/319.1

(Continued)

FOREIGN PATENT DOCUMENTS

DE 19958817 A1 6/2001
JP 2000-161683 A 6/2000

(Continued)

*Primary Examiner* — Jeffrey O'Brien
(74) *Attorney, Agent, or Firm* — NKL Law; Jae Youn Kim

(57) ABSTRACT

Proposed is a hinge device having tension maintaining function, the hinge device including: a winding member affixed to a main body of a mounted structure having an inner space formed therein; a hinge member affixed to a door that opens or closes the inner space and mounted on the winding member so as to enable the door to be pivotable; and a tension member having one end affixed to the winding member and the other end affixed to the hinge member, such that the tension member transmits a tension to the door when opening and closing the door.

6 Claims, 7 Drawing Sheets

(52) U.S. Cl.
CPC ..... *E05Y 2201/48* (2013.01); *E05Y 2201/654* (2013.01); *E05Y 2201/688* (2013.01); *E05Y 2900/304* (2013.01)

(56) References Cited

U.S. PATENT DOCUMENTS

| | | | | |
|---|---|---|---|---|
| 5,988,933 | A * | 11/1999 | Wilhelmstatter | F16G 11/03 49/386 |
| 7,862,132 | B2 * | 1/2011 | Tynes | A47L 15/4261 312/328 |
| 8,042,891 | B2 * | 10/2011 | Tynes | A47L 15/4261 312/328 |
| 8,043,442 | B2 * | 10/2011 | Haeberle | A47L 15/4261 312/319.1 |
| 8,283,611 | B2 * | 10/2012 | Choi | E05D 11/1028 219/524 |
| 8,292,381 | B2 * | 10/2012 | McDaniel | A47L 15/4261 49/386 |
| 8,882,933 | B2 * | 11/2014 | Assmann | A47L 15/488 134/58 DL |
| 8,931,859 | B2 * | 1/2015 | Kozinski | E05F 5/00 312/328 |
| 9,498,102 | B2 * | 11/2016 | Chae | A47L 15/4261 |
| 10,301,866 | B2 * | 5/2019 | Margonari | E05F 15/611 |
| 10,655,376 | B2 * | 5/2020 | Saylor | E05F 1/1075 |
| 11,499,359 | B2 * | 11/2022 | Köhler | E05F 15/627 |
| 11,547,269 | B2 * | 1/2023 | Friedke | A47L 15/4259 |
| 2004/0113531 | A1 * | 6/2004 | Raches | A47L 15/4261 312/319.2 |
| 2011/0241507 | A1 * | 10/2011 | Diebold | A47L 15/4261 312/328 |
| 2017/0138106 | A1 | 5/2017 | Stuke | |
| 2018/0044960 | A1 * | 2/2018 | Saylor | E05F 1/1075 |
| 2020/0232264 | A1 | 7/2020 | Saylor | |
| 2022/0098913 | A1 | 3/2022 | Saylor | |
| 2022/0322911 | A1 * | 10/2022 | Friedke | A47L 15/4259 |
| 2022/0361727 | A1 * | 11/2022 | Ryan | A47L 15/4261 |

FOREIGN PATENT DOCUMENTS

| | | | |
|---|---|---|---|
| KR | 20-0243085 | Y1 | 9/2001 |
| KR | 10-0936761 | B1 | 1/2010 |
| KR | 10-1138299 | B1 | 4/2012 |

* cited by examiner

HINGE DEVICE HAVING TENSION MAINTAINING FUNCTION

TECHNICAL FIELD

The present invention relates to a hinge device having a tension maintaining function, and more particularly, to a hinge device having a tension maintaining function that is a device applied to a mounting structure of a dishwasher, an oven, or the like, includes a tension member and a leaf spring, and adds a force for closing a door through a tension of the tension member when a door is opened or closed using a winding member fixed to a body and a hinge member fixed to the door.

BACKGROUND ART

In general, mounting structures of dishwashers, ovens, or the like each include a body having an inner space and a door installed on a front surface of the body to open or close the inner space.

In this case, a hinge device is installed at a connection part between the body and the door to facilitate the opening and closing operation of the door.

The hinge device needs to be configured to have a structure in which, for the safety of a user using the mounting structures of the dishwashers, the ovens, or the like, the door may be more safely opened when being opened and may be smoothly closed when being closed.

Further, since the hinge devices are individually operated on both sides of the door, when there is even a slight difference between opening and closing degrees of both sides of the door, a posture of the door is distorted. Thus, a larger force is required to open or close the door, and noise is generated due to a pinching operation.

Furthermore, the doors of the mounting structures of the dishwasher, the oven, or the like have considerable weights because the inside of the body should be tightly closed without any gaps, and thus the user consumes a considerable force when the doors are opened or closed due to the weights of the doors.

Thus, the need for a hinge device having a tension maintaining function that allows the user to more smoothly open or close the door by applying a continuous tension to the door has been increased.

RELATED ART DOCUMENT (Patent Document 1) Korean Patent Application Publication No. 10-2012-0019787 (Mar. 7, 2012)

DISCLOSURE

Technical Problem

The present invention is directed to providing a hinge device having a tension maintaining function that is a device applied to a mounting structure of a dishwasher, an oven, or the like, includes a tension member and a leaf spring, and adds a force for closing a door through a tension of the tension member when a door is opened or closed using a winding member fixed to a body and a hinge member fixed to the door.

Technical Solution

One aspect of the present invention provides a hinge device having a tension maintaining function, the hinge device including a winding member fixed to a body of a mounting structure, the body having an inner space, a hinge member fixed to a door that opens or closes the inner space and mounted on the winding member so that the door rotates, and a tension member having one end fixed to the winding member and the other end fixed to the hinge member and configured to transmit a tension to the door when the door is opened or closed.

The hinge device may further include a leaf spring mounted on the winding member and configured to add a force for closing the door by maintaining a tension of the tension member when the door is opened or closed.

The winding member may include a housing fixed to the body, a plurality of first rollers mounted on the housing and having first winding parts, and at least one second roller mounted on the housing and having a first winding part and a second winding part which are formed separately from each other, and the leaf spring may be mounted on the first winding parts of the first rollers and the second roller.

Seating parts, on which the first rollers are seated, may be further provided in the housing, and a width length (L1) of the seating part may correspond to a width length (L2) of the second winding part of the second roller.

The hinge device may further include a synchronization bar having one end coupled to the hinge member at one side of the door and the other end coupled to the hinge member at the other side of the door and configured to synchronize an opening and closing operation of the door.

The hinge member may include a base part detachably mounted on the winding member and a rotation part rotatably mounted on the base part, fixed to the door, and configured to rotate together with the door according to a rotation movement of the door.

The rotation part may include a rotation center part, a first rotation bar formed integrally with the rotation center part and fixed to the door, and a second rotation bar formed integrally with the rotation center part and connected to one end of the synchronization bar.

The leaf spring may be mounted on adjacent first winding parts in an "S" shape.

Advantageous Effects

According to an aspect of the present invention, a hinge device having a tension maintaining function according to the present invention includes a synchronization bar that synchronizes an opening and closing operation of a door so that there is little difference between opening and closing degrees of both sides of the door, and thus a jamming phenomenon of the door or a noise phenomenon that can occur depending on the difference between the opening and closing degrees of both sides of the door can be prevented.

Further, the hinge device having a tension maintaining function according to the present invention includes a tension member that transmits a tension to the door and a leaf spring that maintains the tension of the tension member, thereby adding a force for closing the door.

Further, the hinge device having a tension maintaining function according to the present invention includes a winding member fixed to a body and a hinge member attached to or detached from the winding member, and thus the door can also be easily coupled to or separated from the body.

The effects of the present invention are not limited to the above effects and should be understood to include all effects that can be deduced from the detailed description of the present invention or the configuration of the present invention described in the appended claims.

MODES OF THE INVENTION

Figure 1:
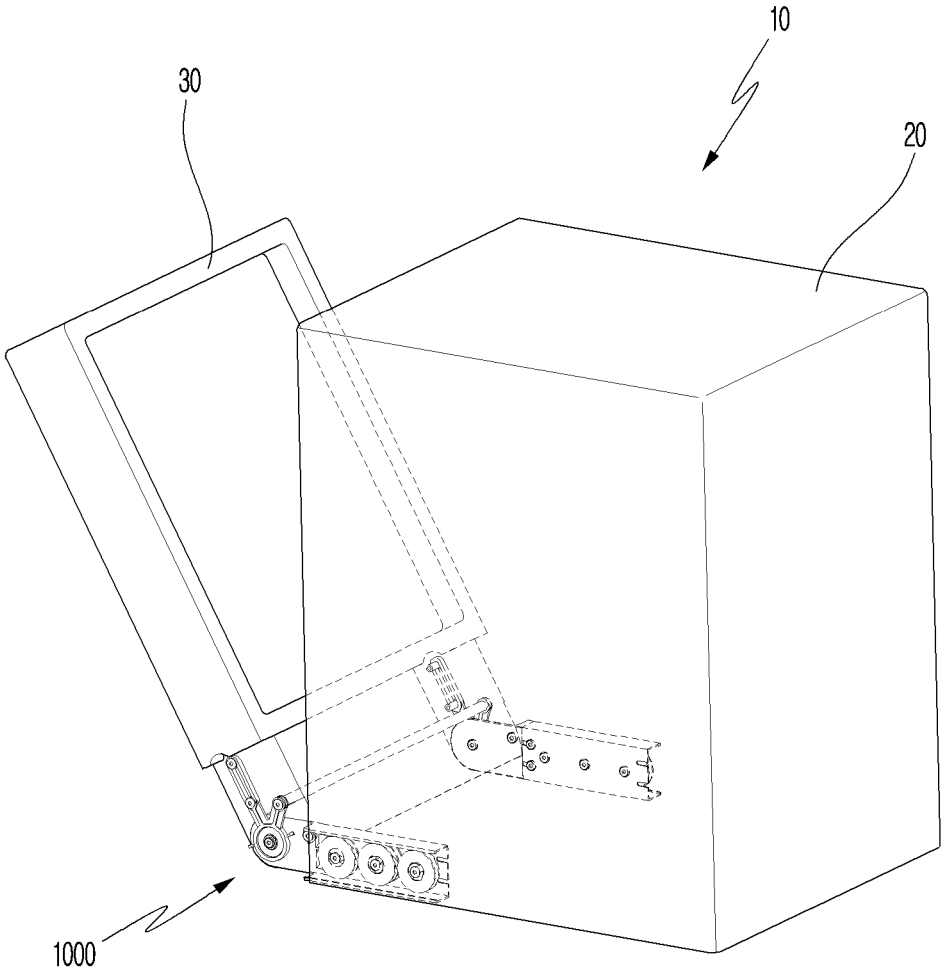
FIG. 1 is a perspective view of a mounting structure equipped with a hinge device having a tension maintaining function according to an embodiment of the present invention.

Hereinafter, the present invention will be described with reference to the accompanying drawings. However, the present invention may be implemented in various different forms and thus is not limited to embodiments described herein. Further, in the drawings, parts irrelevant to the description are omitted in order to clearly describe the present invention, and throughout the specification, similar numerals reference numerals are assigned to similar parts.

Throughout the specification, when a first part is connected to a second part, this includes not only a case in which the first part is "directly connected" to the second part but also a case in which the first part is "indirectly connected" to the second part with a third part interposed therebetween. Further, when a part "includes" a component, this means that another component is not excluded but may be further included unless otherwise stated.

Hereinafter embodiments of the present invention will be described in detail with reference to the accompanying drawings.

Figure 2A:
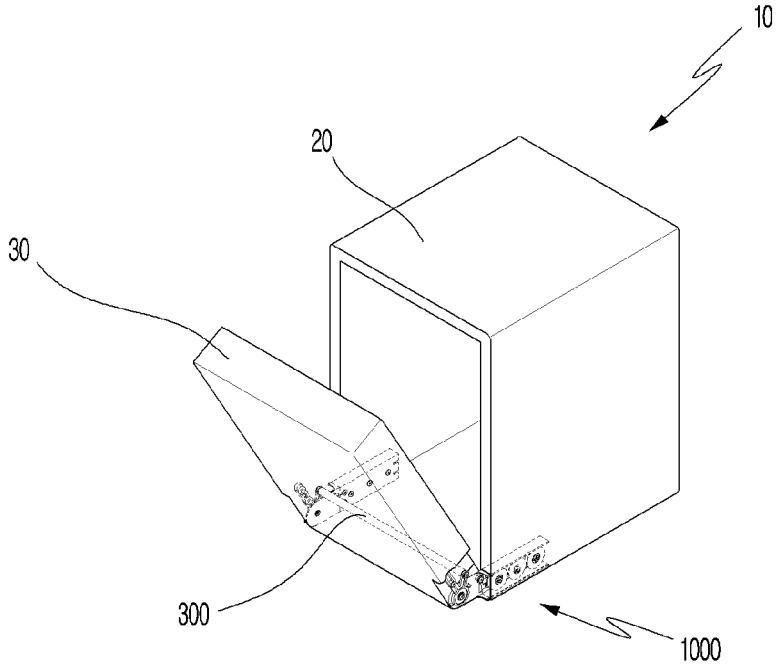
FIGS. 2A-2B are perspective views of an operation state of the mounting structure equipped with the hinge device having a tension maintaining function according to the embodiment of the present invention.
Figure 2B:
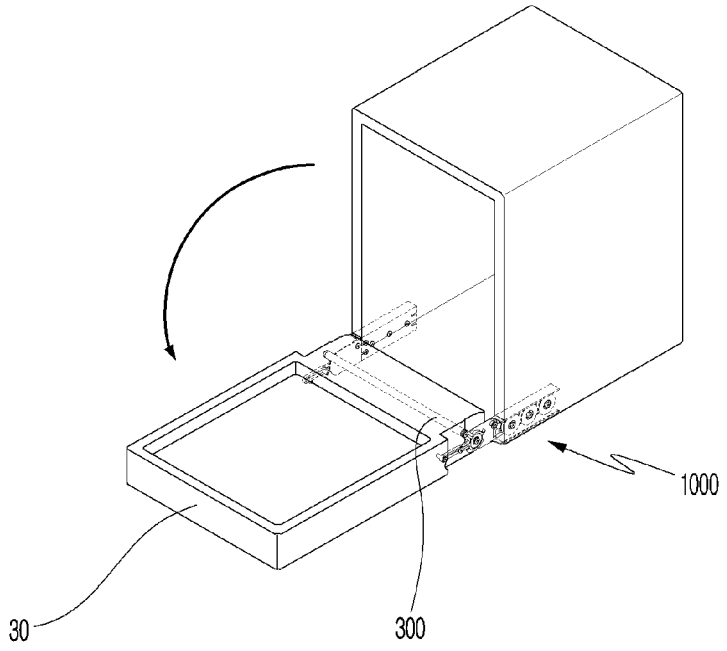
Figure 3A:
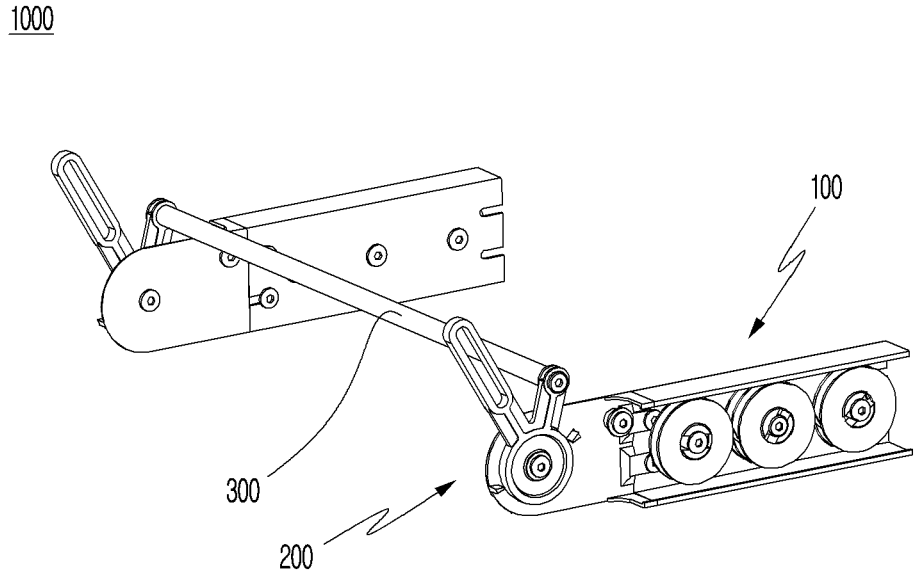
FIGS. 3A-3B are perspective views of the hinge device having a tension maintaining function according to the embodiment of the present invention.
Figure 3B:
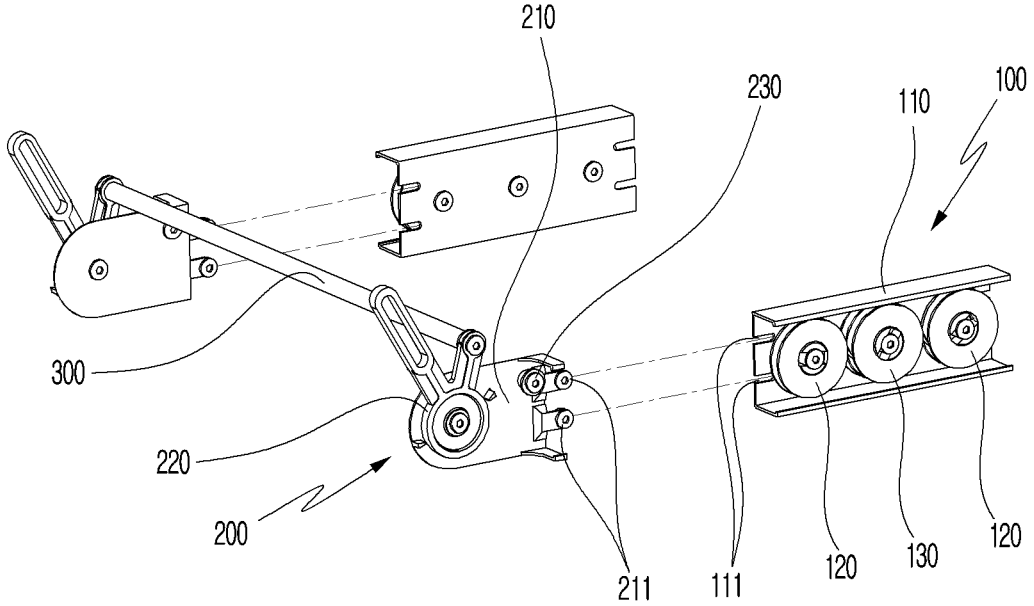

FIG. 1 is a perspective view of a mounting structure equipped with a hinge device having a tension maintaining function according to an embodiment of the present invention, FIGS. 2A-2B are perspective views of an operation state of the mounting structure equipped with the hinge device having a tension maintaining function according to the embodiment of the present invention, and FIGS. 3A-3B are perspective views of the hinge device having a tension maintaining function according to the embodiment of the present invention.

In general, a mounting structure 10 of an oven, a dishwasher, or the like includes a body 20 having an inner space formed therein and a door 30 mounted in the front of the body 20 to open or close the inner space. Further, the door 30 is configured so that a lower part of the door 30 is rotatably coupled to the body 20, and thus the door 30 is opened while rotating about a rotary shaft from the top to the bottom and is closed while rotating from the bottom to the top.

In this case, a hinge device 1000 having a tension maintaining function according to the present invention is mounted at a connection part between the body 20 and the door 30 to facilitate the opening and closing operation of the door 30.

Referring to FIGS. 1 to 3, the hinge device 1000 having a tension maintaining function according to the present invention includes a winding member 100 fixed to the body 20 of the mounting structure, the body 20 having an inner space formed therein, a hinge member 200 fixed to the door 30 that opens or closes the inner space and mounted on the winding member 100 so that the door 30 is rotatable, and a tension member 400 having one end fixed to the winding member 100 and the other end fixed to the hinge member 200 and configured to transmit a tension to the door 30 when the door 30 is opened or closed.

Further, the hinge device 1000 may further include a synchronization bar 300 that has one end coupled to the hinge member 200 at one side of the door 30 and the other end coupled to the hinge member 200 at the other side of the door 30 and synchronizes the opening and closing operations of the door 30.

In the hinge device 1000 having a tension maintaining function, the winding members 100 are mounted on both sides of the body 20, the hinge members 200 are mounted on both sides of the door 30, and both hinge members 200 are connected through the synchronization bar 300. Accordingly, the hinge device 1000 having a tension maintaining function synchronizes the opening and closing operations of the door 30 so that, when one side of the door 30 is opened, the other side of the door 30 is also opened, and when the one side of the door 30 is closed, the other side of the door 30 is also closed.

That is, the hinge device 1000 having a tension maintaining function according to the present invention is configured so that there is little difference between opening and closing degrees of both sides of the door 30, and thus a jamming phenomenon of the door or a noise phenomenon, which may occur depending on the difference between the opening and closing degrees of both sides of the door 30, may be prevented.

Further, the hinge member 200 fixed to the door 30 may be attached to or detached from the winding member 100 fixed to the body 20, and accordingly, the door 30 may be also easily coupled to or separated from the body 20.

Figure 4:
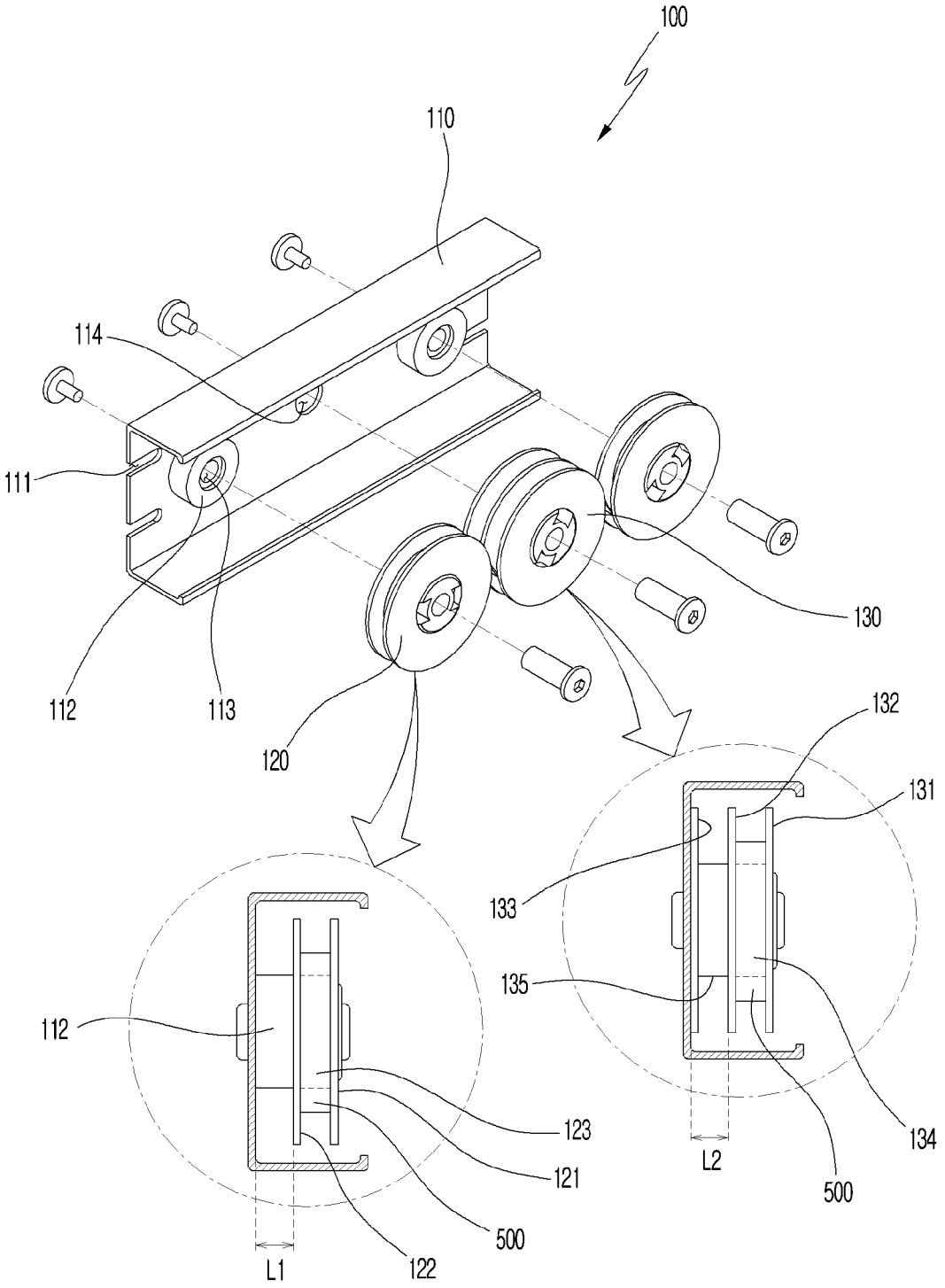
FIG. 4 shows an exploded view and partial enlarged views of a winding member according to the embodiment of the present invention.
Figure 5:
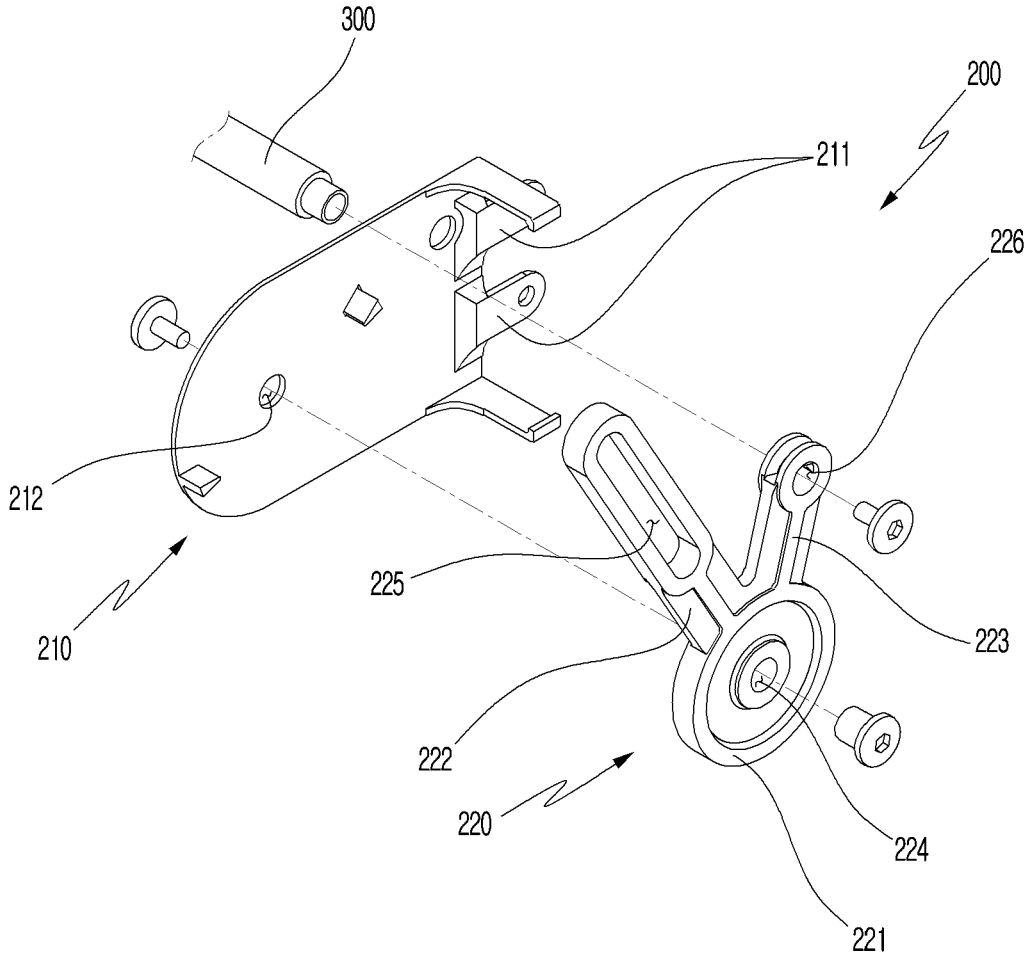
FIG. 5 is an exploded view of a hinge member according to the embodiment of the present invention.
Figure 6A:
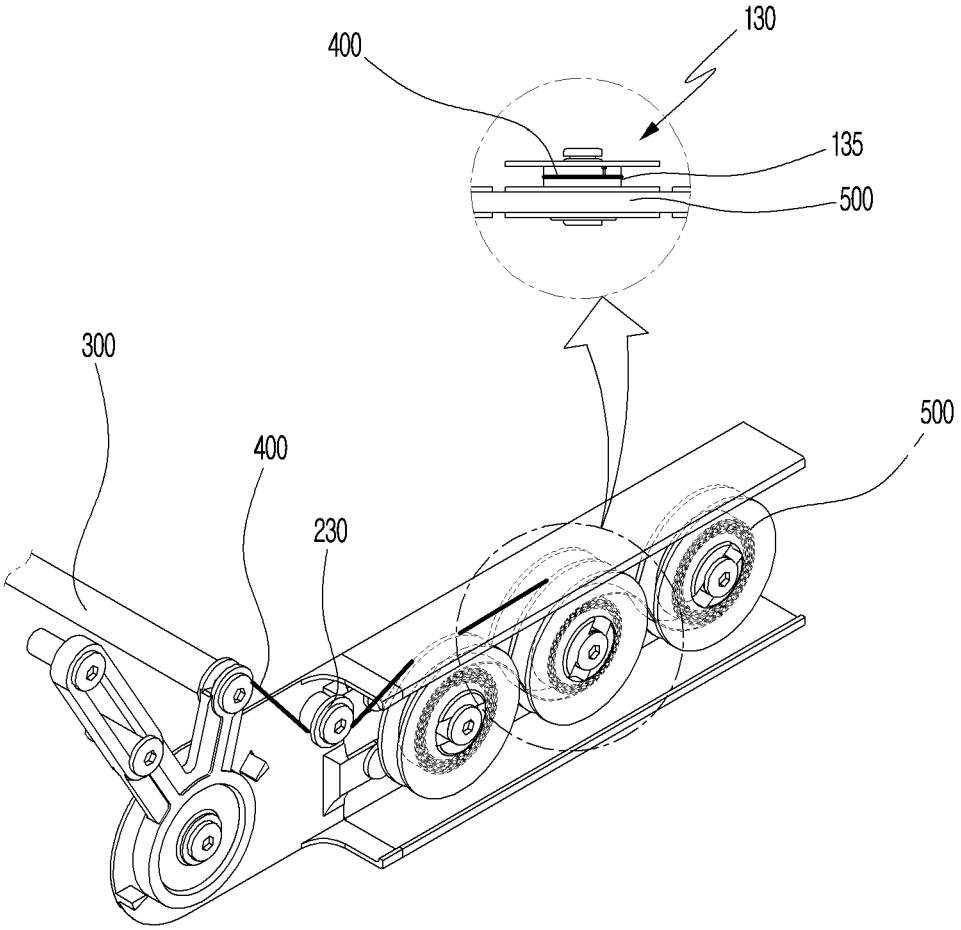
FIGS. 6A-6B show perspective views and front views of the hinge device having a tension maintaining function to which a tension member and a leaf spring are coupled according to the embodiment of the present invention.
Figure 6B:
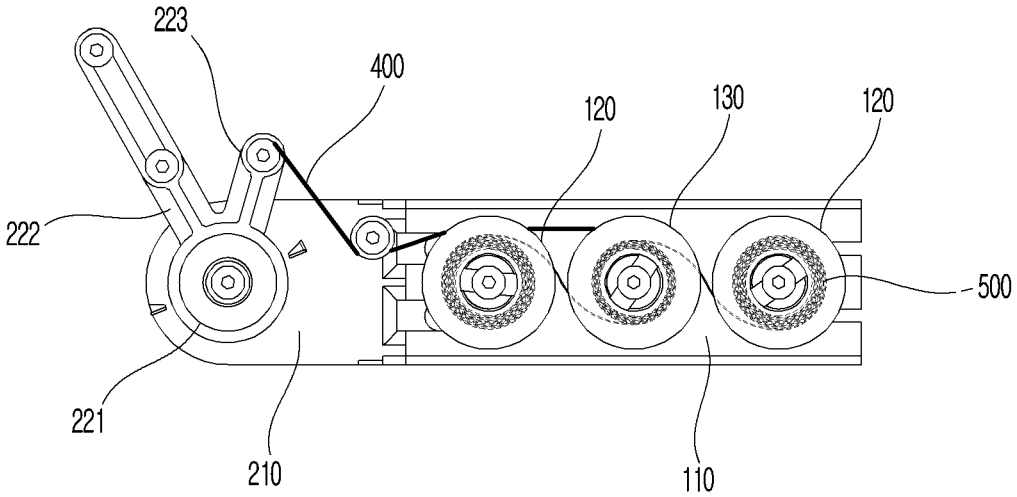

FIG. 4 shows an exploded view and partial enlarged views of a winding member according to the embodiment of the present invention, FIG. 5 is an exploded view of a hinge member according to the embodiment of the present invention, and FIGS. 6A-6B show perspective views and front views of the hinge device having a tension maintaining function to which a tension member and a leaf spring are coupled according to the embodiment of the present invention.

Referring to FIGS. 3 to 6, the winding member 100 includes a housing 110 fixed to the body 20, a plurality of first rollers 120 mounted on the housing 110 and having first winding parts 123 formed therein, and at least one second roller 130 mounted on the housing 110 and having a first winding part 134 and a second winding part 135 which are formed separately from each other.

In this case, the first rollers 120 and the second roller 130 may be arranged in series in the housing 110. It is preferable that three rollers, including the first roller 120, the second roller 130, and the first roller 120 in this order, may be arranged in the housing 110.

According to the embodiment, the tension member 400 has one end fixed to the second winding part 135 of the second roller 130 and the other end fixed to the hinge member 200 coupled to the door 30 and thus may be configured to transmit the tension to the door 30 when the door 30 is opened or closed.

In more detail, the tension member 400 is connected to a second rotation bar 223 of the hinge member 200 coupled to the door 30, as will be described below, to transmit the tension to the door 30, and repeats an operation of being unwound from or wound around the second winding part 135 according to the opening or closing operation of the door 30. The tension member 400 may be a wire, a band, or a metal band.

In this way, the hinge device 1000 having a tension maintaining function supports the overall movement of the door 30 by the tension of the tension member 400.

In this case, in order to maintain the tension of the tension member 400 connected to the door 30, leaf springs 500 may be further provided in the first rollers 120 and the second roller 130.

The leaf springs 500 are mounted on the first winding parts 123 of the first rollers 120 and the first winding part 134 of the second roller 130 and serve to add a force for closing the door 30 by maintaining the tension of the tension member 400 in a closing direction of the door 30 when the door 30 is opened or closed.

Accordingly, in the hinge device 1000 having a tension maintaining function according to the present invention, when the door 30 is opened, the door 30 is prevented from being suddenly opened in the direction of gravity by a weight of the door 30 itself, and thus safety can be achieved, and when the door 30 is closed, the tension forces of the leaf springs 500 are added to the closing force, and thus convenience of use can be achieved.

Further, in the hinge device 1000 having a tension maintaining function, the hinge member 200 at one side of the door 30 rotates together with the hinge member 200 at the other side of the door 30 which is paired through the synchronization bar 300, the door 30 is configured to be opened by rotation amounts of both the first rollers 120 and the second roller 130, and accordingly, the opening and closing operations of both sides of the door 30 may be synchronized.

Meanwhile, referring to FIGS. 3 to 6, the housing 110, which is a part fixedly coupled to an inner surface of the body 20, may be formed in a shape in which the first rollers 120 and the second roller 130 may be arranged and preferably may be formed to have an "⊂" shaped cross-sectional shape.

The housing 110 has coupling grooves 111 that are coupled to coupling protrusions 211 of the hinge member 200 on one side thereof, a plurality of seating parts 112 that have first coupling holes 113 so that the first rollers 120 are seated thereon and coupled thereto, and at least one second coupling hole 114 to which the second roller 130 is coupled.

The housing 110 may be coupled to the coupling protrusions 211 of the hinge member 200 through the coupling grooves 111 in an insertion-coupling manner or a screw-coupling manner, but the present invention is not limited thereto, and any coupling method capable of firmly coupling the housing 110 and the hinge member 200 may be applied.

The first rollers 120 are seated on the seating parts 112 of the housing 110 and are rotatably coupled through the coupling holes 113 of the seating parts 112.

The first roller 120 may include the first winding part 123 formed using a first plate 121 and a second plate 122. One end of the leaf spring 500 is fixed to the first winding part 123, and the extra leaf spring 500 may be rolled and wound on the first winding part 123.

The second roller 130 is rotatably coupled to the housing 110 through the second coupling hole 114.

The second roller 130 may include the first winding part 134 formed using a first plate 131 and a second plate 132 parallel to each other and the second winding part 135 formed using the second plate 132 and a third plate 133 parallel to each other. In this case, one end of the leaf spring 500 may be fixed to the first winding part 134, and the extra leaf spring 500 may be rolled and wound on the first winding part 134. One end of the tension member 400 may be fixed to the second winding part 135, and the extra tension member 400 may be rolled and wound on the second winding part 135.

According to the embodiment, the leaf spring 500 may be mounted in an "S" shape on the first winding parts 123 of two adjacent first rollers 120 or on the first winding parts 123 and 134 of the first roller 120 and the second roller 130 adjacent to each other. Further, the tension member 400 may have one end fixed to the second winding part 135 of the second roller 130 and the other end mounted on the second rotation bar 223 of the hinge member 200, which will be described below.

That is, when the door 30 to which the other end of the tension member 400 is fixed is opened, the second roller 130 to which the one end of the tension member 400 is fixed is rotated, the leaf spring 500 mounted in the "S" shape on the first rollers 120 and the second roller 130 is wound, and thus the first roller 120 also rotates at the same time.

In this case, the leaf spring 500 serves to add the force for closing the door 30 by maintaining the tension of the tension member 400 in the closing direction of the door 30 when the door 30 is opened or closed.

According to the embodiment, a width length L1 of the seating part 112, which is provided in the housing 110 and on which the first roller 120 is seated, may be formed to correspond to a width length L2 of the second winding part 135 of the second roller 130.

Accordingly, when the first rollers 120 and the second roller 130 are mounted on the housing 110 in series, the seating part 112 compensates for a difference between the width length of the first roller 120 having only the first winding part 123 and the width length of the second roller 130 having the first winding part 134 and the second winding part 135, and thus the leaf spring 500 may be more easily wound collinearly on the first winding parts 123 and 134.

Referring to FIGS. 3 to 6, the hinge member 200 includes a base part 210 detachably mounted on the winding member 100 and a rotation part 220 rotatably mounted on the base part 210, fixed to the door 30, and configured to rotate together with the door according to the rotation movement of the door 30. That is, the base part 210 is fixed to the door 30 through the rotation part 220 rotatably mounted on the base part 210.

In more detail, the base part 210 has the coupling protrusions 211 coupled to the coupling grooves 111 of the winding member 100 and a third coupling hole 212 coupled to the rotation part 210. In this case, the base part 210 may be coupled to the coupling grooves 111 of the winding member 100 through the coupling protrusions 211 in an insertion-coupling manner or a screw-coupling manner, but the present invention is not limited thereto, and any coupling method capable of firmly coupling the housing 110 and the hinge member 200 may be applied.

The rotation part 220 has a rotation center part 221 having a fourth coupling hole 224 and rotatably coupled to the base part 210, a first rotation bar 222 formed integrally with the rotation center part 221 and fixed to the door, and the second rotation bar 223 formed integrally with the rotation center part 221 and connected to one end of the synchronization bar 300.

The rotation center part 221 is rotatably coupled to the third coupling hole 212 formed in the base part 210 through the fourth coupling hole 224.

The first rotation bar 222 may be formed in a bar shape on one side of the rotation center part 221 and may include a slot 225. The first rotation bar 222 may be screw-coupled to the door 30 through the slot 225. Accordingly, the rotation part 220 may also rotate about a rotary shaft according to the rotation operation of the door 30.

The second rotation bar 223 may be formed in a bar shape on one side of the rotation center part 221 and may include an accommodation hole 226. The second rotation bar 223 may be coupled to one end of the synchronization bar 300 through the accommodation hole 226. Further, one end of the tension member 400 may be coupled to the second rotation bar 223.

That is, the first rotation bar 222 and the second rotation bar 223 rotate due to the rotation operation of the door 30, and accordingly, the tension member 400 coupled to the second rotation bar 223 transmits the tension to the door 30.

In this case, the base part 210 may further include a retainer 230. Accordingly, the retainer 230 deflects the direction of the tension member 400 to be close to the horizontal so that the tension member 400 may be easily wound around the second winding part 135 of the second roller 130.

In this way, the hinge device 1000 having a tension maintaining function according to the present invention may synchronize the operation of the door 30 through the winding member 100 fixed to the body 20, the hinge member 200 fixed to the door 30, and the synchronization bar 300 connecting the hinge members 200 provided on both sides of the door 30 and may add the force for closing the door 30 through the tension member 400 connected to the winding member 100 and the hinge member 200 and the leaf spring 500 provided in the winding member 100 and configured to maintain the tension of the tension member 400.

The above description of the present invention is merely illustrative, and those skilled in the art to which the present invention pertains can understand that the present invention can be easily modified in other specific forms without changing the technical spirit or essential features of the present invention. Therefore, it should be understood that the embodiments described above are illustrative but not limiting in all aspects. For example, components described as a single type may be implemented in a distributed manner, and likewise, components described as a distributed manner may also be implemented in a coupled form.

The scope of the present invention is indicated by the appended claims, and all changes or modifications derived from the meaning and scope of the appended claims and equivalent concepts thereof should be construed as being included in the scope of the present invention.

DESCRIPTION OF REFERENCE NUMERALS

1000: Hinge device having tension maintaining function
100: Winding member
110: Housing
120: First roller
130: Second roller
200: Hinge member
210: Base part
220: Rotation part
300: Synchronization bar
400: Tension member
500: Leaf spring
10: Mounting structure
20: Body
30: Door

What is claimed is:

1. A hinge device having a tension maintaining function, the hinge device comprising:

a winding member fixed to a body of a mounting structure, the body having an inner space;

a hinge member fixed to a door that opens or closes the inner space and mounted on the winding member so that the door rotates;

a tension member having one end fixed to the winding member and the other end fixed to the hinge member and configured to transmit a tension to the door when the door is opened or closed; and a leaf spring mounted on the winding member and configured to add a force for closing the door by maintaining a tension of the tension member when the door is opened or closed, wherein the winding member includes a housing fixed to the body, a plurality of first rollers mounted on the housing and having first winding parts, and at least one second roller mounted on the housing and having a first winding part and a second winding part which are formed separately from each other, and wherein the leaf spring is mounted on the first winding parts of the first rollers and the second roller.

2. The hinge device of claim 1, wherein seating parts, on which the first rollers are seated, are further provided in the housing, and a width length of the seating part corresponds to a width length of the second winding part of the second roller.

3. The hinge device of claim 2, further comprising:

another hinge member; and a synchronization bar having one end coupled to the hinge member at a first side of the door and the other end coupled to the another hinge member at a second side of the door and configured to synchronize an opening and closing operation of the door.

4. The hinge device of claim 3, wherein the hinge member includes a base part detachably mounted on the winding member and a rotation part rotatably mounted on the base part, fixed to the door, and configured to rotate together with the door according to a rotation movement of the door.

5. The hinge device of claim 4, wherein the rotation part includes a rotation center part, a first rotation bar formed integrally with the rotation center part and fixed to the door, and a second rotation bar formed integrally with the rotation center part and connected to one end of the synchronization bar.

6. The hinge device of claim 1, wherein the leaf spring is mounted on adjacent first winding parts in an "S" shape.

* * * * *